US012560324B2

(12) United States Patent
Naik et al.

(10) Patent No.: US 12,560,324 B2
(45) **Date of Patent: *Feb. 24, 2026**

(54) COMBUSTION SECTION WITH A PRIMARY COMBUSTOR AND A SET OF SECONDARY COMBUSTORS

(71) Applicant: GENERAL ELECTRIC COMPANY, Evendale, OH (US)

(72) Inventors: Pradeep Naik, Bengaluru (IN); Joseph Zelina, Waynesville, OH (US); Sripathi Mohan, Bengaluru (IN); Perumallu Vukanti, Bengaluru (IN); Clayton S. Cooper, Loveland, OH (US); Michael A. Benjamin, Cincinnati, OH (US); Steven C. Vise, Loveland, OH (US); Karthikeyan Sampath, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/952,330

(22) Filed: Nov. 19, 2024

(65) Prior Publication Data

US 2025/0075910 A1 Mar. 6, 2025

Related U.S. Application Data

(63) Continuation of application No. 18/486,368, filed on Oct. 13, 2023, now Pat. No. 12,173,898.

(30) Foreign Application Priority Data

Sep. 1, 2023 (IN) ..... 202311058788

(51) Int. Cl.
*F23R 3/00* (2006.01)
*F23R 3/42* (2006.01)

(52) U.S. Cl.
CPC ..... *F23R 3/002* (2013.01); *F23R 3/42* (2013.01)

(58) Field of Classification Search
CPC ..... F23R 3/002; F23R 3/346; F23R 3/42
See application file for complete search history.

(56) References Cited

U.S. PATENT DOCUMENTS 2,531,810 A 11/1950 Fyffe
4,192,139 A 3/1980 Buchheim
(Continued)

FOREIGN PATENT DOCUMENTS

CA 2040780 A1 11/1991
EP 1659338 A1 5/2006
FR 3080672 B1 5/2020

*Primary Examiner* — David P. Olynick
(74) *Attorney, Agent, or Firm* — Carter, DeLuca & Farrell LLP

(57) ABSTRACT

A turbine engine with a compressor section, a combustion section, and a turbine section in serial flow arrangement along an engine centerline. A combustion section for the turbine engine, having a primary combustor liner including an inner liner and an outer liner annular about an engine centerline. A dome wall extending between the inner liner and the outer liner. A set of primary dome inlets located in the dome wall and circumferentially arranged about the engine centerline. A set of secondary combustors fluidly coupled to a primary combustion chamber, the set of secondary combustors including a first mini combustor and a second mini combustor.

17 Claims, 14 Drawing Sheets

(56) References Cited

U.S. PATENT DOCUMENTS

| | | | |
|---|---|---|---|
| 4,765,146 | A | 8/1988 | Hellat et al. |
| 4,827,724 | A | 5/1989 | Maghon et al. |
| 5,121,597 | A | 6/1992 | Urushidani et al. |
| 5,802,854 | A | 9/1998 | Maeda et al. |
| 6,481,209 | B1 | 11/2002 | Johnson et al. |
| 6,889,495 | B2 | 5/2005 | Hayashi et al. |
| 6,951,108 | B2 | 10/2005 | Burrus et al. |
| 8,931,283 | B2 | 1/2015 | Khan et al. |
| 8,991,189 | B2 | 3/2015 | Joshi et al. |
| 9,400,113 | B2 | 7/2016 | Ogata et al. |
| 10,060,629 | B2 | 8/2018 | Kim et al. |
| 11,313,561 | B2 | 4/2022 | Roh |
| 2014/0366551 | A1 | 12/2014 | Prociw et al. |
| 2016/0123596 | A1 | 5/2016 | Hoke et al. |
| 2019/0162414 | A1 | 5/2019 | Ogata et al. |
| 2022/0195938 | A1* | 6/2022 | Ryon ..... F23R 3/16 |

* cited by examiner

COMBUSTION SECTION WITH A PRIMARY COMBUSTOR AND A SET OF SECONDARY COMBUSTORS

CROSS-REFERENCE TO RELATED APPLICATIONS

This application claims priority to U.S. patent application Ser. No. 18/486,368, filed Oct. 13, 2023, presently allowed, which claims the benefit of and priority to Indian Provisional Patent Application No. 202311058788, filed Sep. 1, 2023, both of which are hereby incorporated by reference in their entirety.

TECHNICAL FIELD

The present subject matter relates generally to a combustion section of a turbine engine, and more specifically to a combustion section with a primary combustor and a secondary combustor.

BACKGROUND

Turbine engines are driven by a flow of combustion gases passing through the engine to rotate a multitude of turbine blades, which, in turn, rotate a compressor to provide compressed air to the combustor for combustion. A combustor can be provided within the turbine engine and is fluidly coupled with a turbine into which the combusted gases flow.

The use of hydrocarbon fuels in the combustor of a turbine engine is known. Generally, air and fuel are fed to a combustion chamber, the air and fuel are mixed, and then the fuel is burned in the presence of the air to produce hot gas. The hot gas is then fed to a turbine where it cools and expands to produce power. By-products of the fuel combustion typically include environmentally unwanted by-products, such as nitrogen oxide and nitrogen dioxide (collectively called NOx), carbon monoxide (CO), unburned hydrocarbons (UHC) (e.g., methane and volatile organic compounds that contribute to the formation of atmospheric ozone), and other oxides, including oxides of sulfur (e.g., SO2 and SO3).

Varieties of fuel for use in combustion turbine engines are being explored. Hydrogen or hydrogen mixed with another element or compound can be used for combustion, however hydrogen or a hydrogen mixed fuel can result in a higher flame temperature than traditional fuels. That is, hydrogen or a hydrogen mixed fuel typically has a wider flammable range and a faster burning velocity than traditional fuels such as petroleum-based fuels, or petroleum and synthetic fuel blends.

Standards stemming from air pollution concerns worldwide regulate the emission of NOx, UHC, and CO generated as a result of the turbine engine operation. In particular, NOx is formed within the combustor as a result of high combustor flame temperatures during operation. It is desirable to decrease NOx emissions while still maintaining desirable efficiencies by regulating the temperature profile and or flame pattern within the combustor.

DETAILED DESCRIPTION

Figure 1:
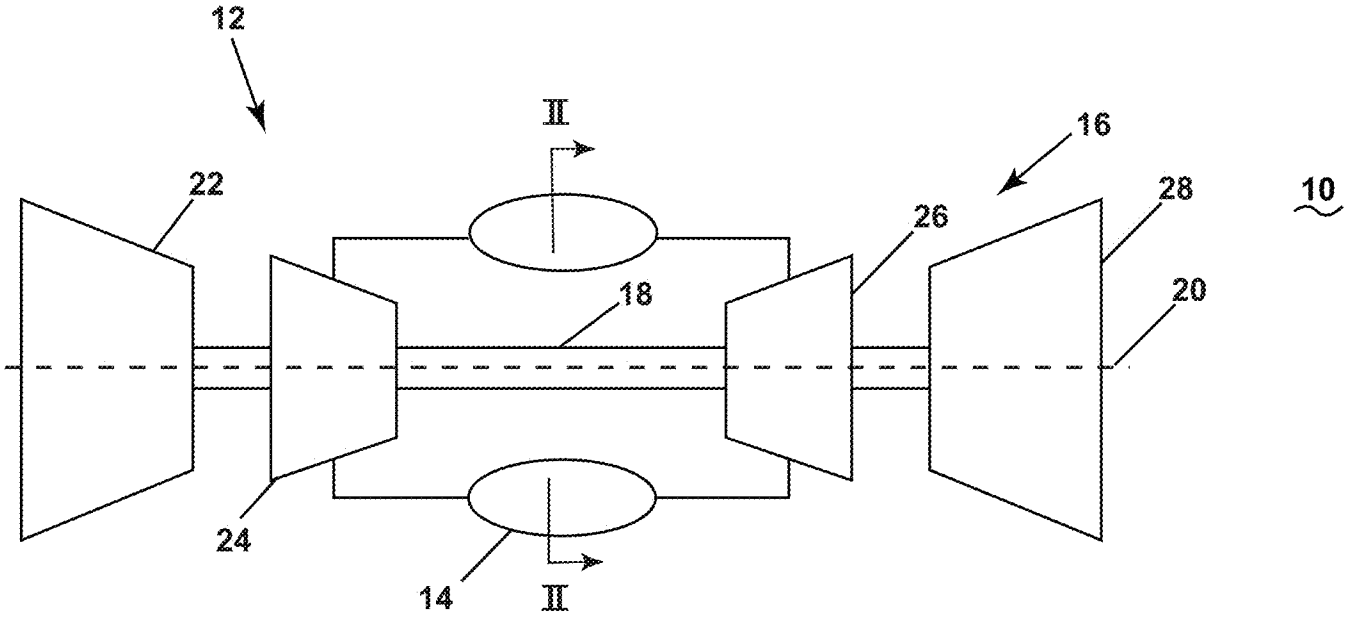
FIG. 1 is a schematic of a turbine engine.

Aspects of the disclosure described herein are directed to a combustion section, and in particular a combustion section with a primary combustor and a set of secondary combustors, where the set of secondary combustors are arranged to exhaust gasses into the primary combustor at different orientations. For purposes of illustration, the present disclosure will be described with respect to a turbine engine. It will be understood, however, that aspects of the disclosure described herein are not so limited and that a combustion section as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The terms "fluidly couples" and "fluidly coupled" mean that a fluid is capable of making the connection between the areas specified.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) may be used for identification purposes to aid the reader's understanding of the present disclosure, and do not create limitations, particularly as to the position, orientation, or use of aspects of the disclosure described herein. Connection references (e.g., attached, coupled, connected, and joined) may be used and are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

Approximating language, as used herein throughout the specification and claims, is applied to modify any quantitative representation that could permissibly vary without resulting in a change in the basic function to which it is related. Accordingly, a value modified by a term or terms, such as "about", "approximately", "generally", and "substantially", are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16. A drive shaft 18 rotationally couples the compressor section 12 and the turbine section 16, such that rotation of one affects the rotation of the other, and defines a rotational axis or engine centerline 20 for the turbine engine 10.

The compressor section 12 can include a low-pressure (LP) compressor 22, and a high-pressure (HP) compressor 24 serially fluidly coupled to one another. The turbine section 16 can include an LP turbine 28, and an HP turbine 26 serially fluidly coupled to one another. The drive shaft 18 can operatively couple the LP compressor 22, the HP compressor 24, the LP turbine 28 and the HP turbine 26 together. Alternatively, the drive shaft 18 can include an LP drive shaft (not illustrated) and an HP drive shaft (not illustrated). The LP drive shaft can couple the LP compressor 22 to the LP turbine 28, and the HP drive shaft can couple the HP compressor 24 to the HP turbine 26. An LP spool can be defined as the combination of the LP compressor 22, the LP turbine 28, and the LP drive shaft such that the rotation of the LP turbine 28 can apply a driving force to the LP drive shaft, which in turn can rotate the LP compressor 22. An HP spool can be defined as the combination of the HP compressor 24, the HP turbine 26, and the HP drive shaft such that the rotation of the HP turbine 26 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section 16 can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 26 at a downstream end of the combustion section 14.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the turbine engine 10 via an exhaust section (not illustrated) downstream of the turbine section 16. The driving of the LP turbine 28 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10.

Figure 2:
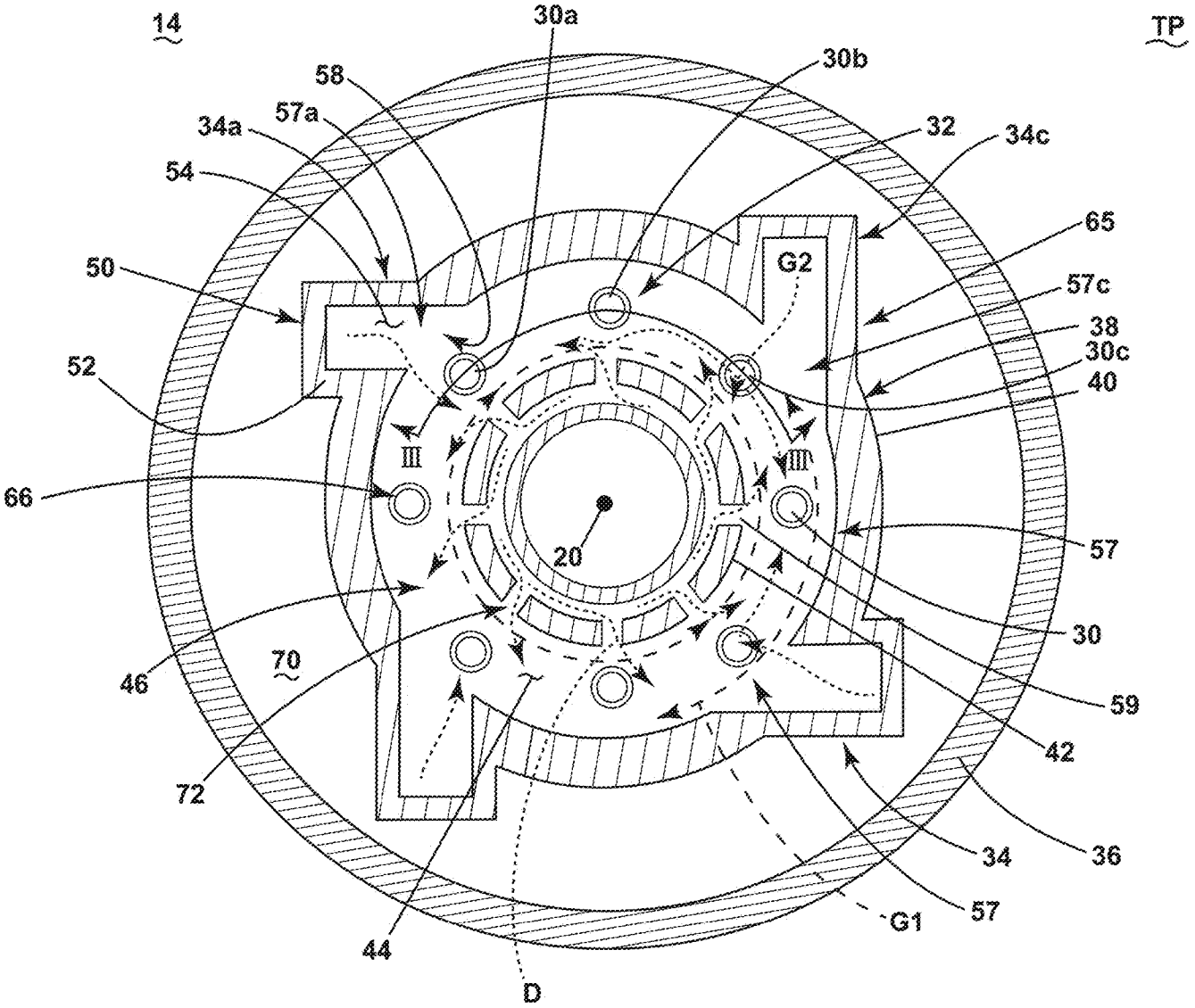
FIG. 2 depicts a cross-sectional view along line II-II of FIG. 1 of a combustion section of the turbine engine defined at least in part by an outer liner and having a set of secondary combustors.

FIG. 2 depicts a cross-sectional view of the combustion section 14 along line II-II of FIG. 1 defining a transverse plane (denoted "TP"). The combustion section 14 can include a primary combustor 32 annular about the engine centerline 20 and having a primary combustor liner 38. The primary combustor liner 38 includes an outer liner 40 and an inner liner 42 concentric with respect to each other. A dome wall 44 extends between the outer liner 40 and the inner liner 42. A primary combustion chamber 46 is defined at least in part by the dome wall 44 and the primary combustor liner 38. A set of primary dome inlets 66 are arranged within the dome wall 44 circumferentially about the engine centerline 20. A set of primary fuel injectors 30 is fluidly coupled to the primary combustion chamber 46 via the set of primary dome inlets 66. It should be appreciated that the annular arrangement of primary dome inlets 66 can be fluidly coupled to one or multiple fuel injectors and one or more of the primary fuel injectors 30 can have different characteristics. The primary combustor 32 can have a can, can-annular, or annular arrangement depending on the type of engine in which the primary combustor 32 is located. In a non-limiting example, an annular arrangement is illustrated and disposed within a casing 36.

The combustion section 14 further includes a circumferential arrangement of mini combustors 34 defining a set of secondary combustors 50. As used herein "mini" means that the component referenced with the term mini is smaller than the corresponding like component without the term mini (i.e., the mini combustor 34 is smaller than the primary combustor 32). Each mini combustor 34 in the set of secondary combustors 50 is defined by a secondary combustor liner 52 extending generally perpendicular from the primary combustor liner 38. The secondary combustor liner 52 defines at least a portion of a secondary combustion chamber 54 circumferentially spaced about the engine centerline 20. The set of secondary combustors 50 is fluidly coupled to the primary combustor 32 by a set of openings 57 extending through the outer liner 40. More specifically, the secondary combustion chamber 54 terminates at the set of openings 57 to define a secondary combustor outlet 58. In a non-limiting example, each secondary combustion chamber 54 in the set of secondary combustors 50 is radially aligned with the primary fuel injectors 30. A primary set of dilution openings 72 can include multiple dilution openings 59 arranged circumferentially about the engine centerline 20 and located in the inner liner 42.

The primary combustor 32 produces primary exhaust gasses (denoted "G1") in the primary combustion chamber 46. The set of secondary combustors 50 produce secondary exhaust gasses (denoted "G2") in the secondary combustion chamber 54 that flow into the primary combustion chamber 46. The secondary exhaust gasses G2 circulate in the primary combustion chamber 46 starving O2 levels and reducing temperatures in the primary combustion chamber 46. This results in a reduction of NOx emissions. A dilution flow (denoted "D") enters the primary combustion chamber 46 via the primary set of dilution openings 72 to trim an exit temperature profile and complete combustion if there is any unburnt product downstream of the set of secondary combustors 50.

The set of secondary combustors 50 includes at least a first mini combustor 34*a*, a second mini combustor 34*b* (FIG. 5), and a third mini combustor 34*c*. A first stage of mini combustors 65 includes at least the first and third mini combustors 34*a*, 34*c*, along with the remaining illustrated mini combustors 34. The set of openings 57 is multiple openings including at least a first opening 57*a* and a third opening 57*c*. The first opening 57*a* corresponds with the first mini combustor 34*a* and the third opening 57*c* corresponds with the third mini combustor 34*c*. The primary fuel injectors 30 include at least a first primary fuel injector 30*a*, a second primary fuel injector 30*b*, and a third primary fuel injector 30*c*.

Figure 3:
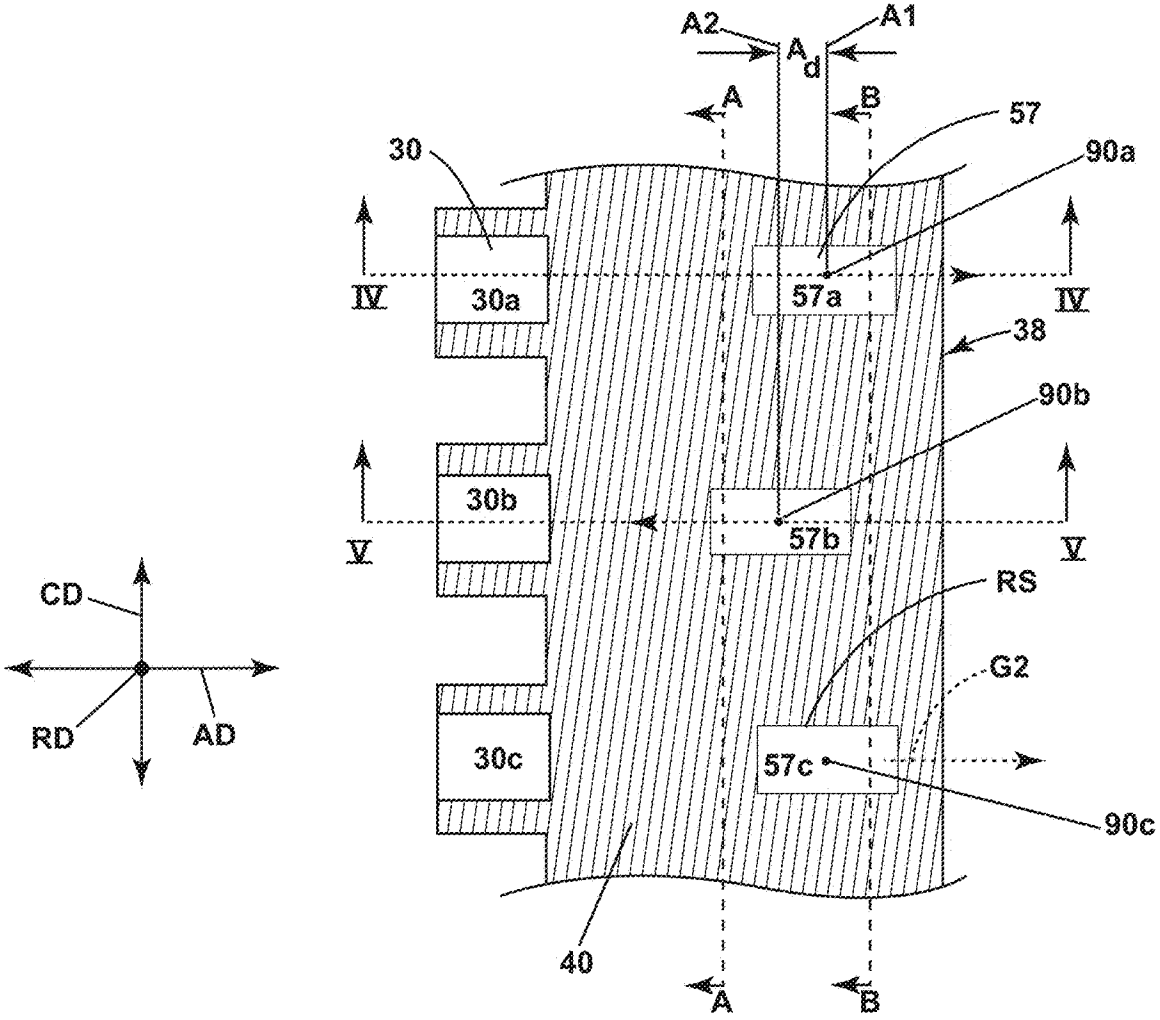
FIG. 3 is schematic portion of the outer liner as seen from line III-III in FIG. 2.

FIG. 3 is a schematic of a portion of the outer liner 40 as seen from line III-III in FIG. 2. An axial direction (denoted "AD") extends parallel to the engine centerline 20 (FIG. 1), a radial direction (denoted "RD") extends into the page and perpendicular to the axial direction AD, and a circumferential direction (denoted "CD") is perpendicular to both the radial and axial directions RD, AD. The circumferential direction CD circumscribes the engine centerline 20 and extends up and down the page when oriented in two dimensions as illustrated.

Figure 5:
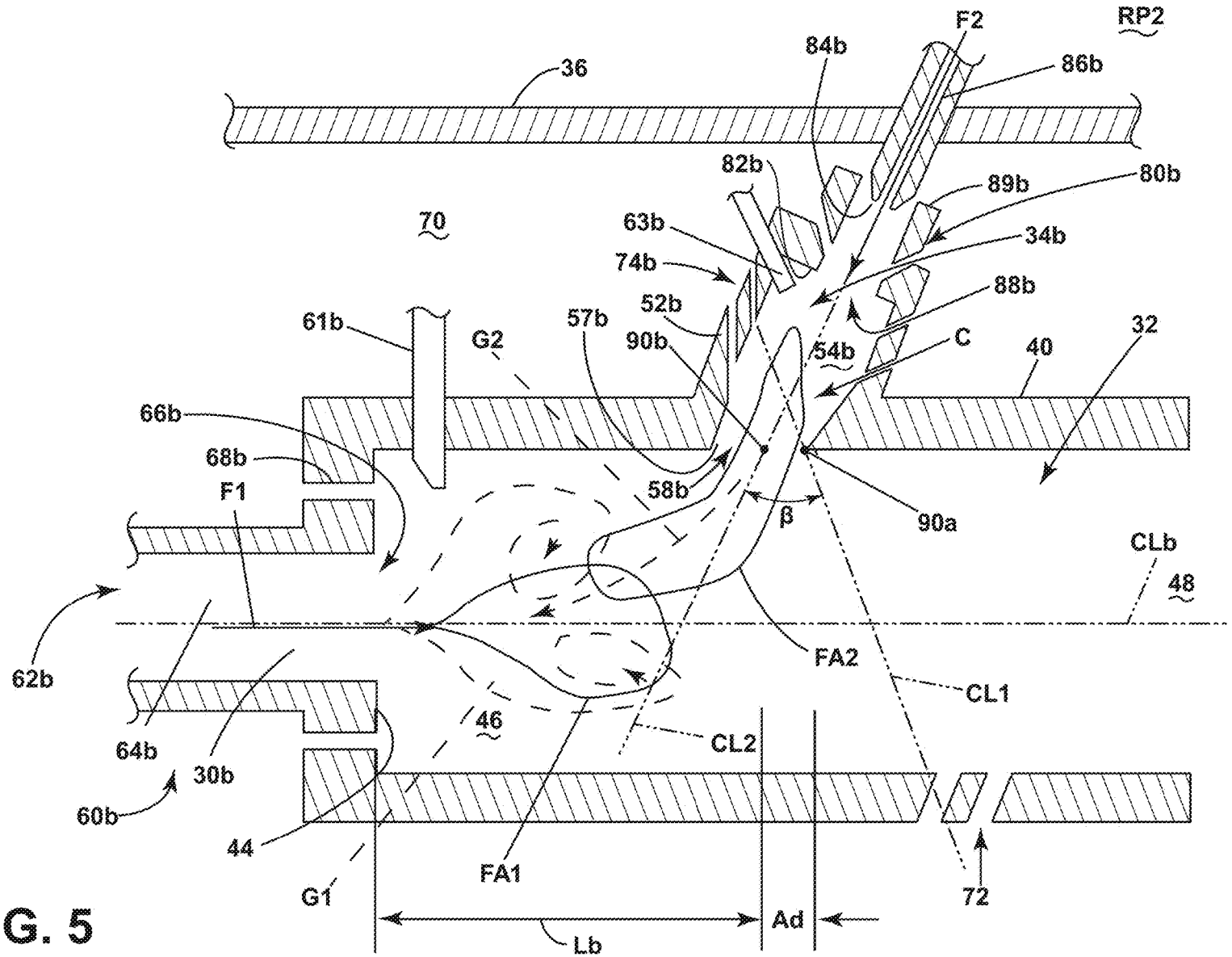
FIG. 5 is a cross-sectional view taken along line V-V of FIG. 3 illustrating a schematic of the combustion section as view in a second radial plane circumferentially spaced from the first radial plane.

It can more clearly be seen that the set of openings 57 in the outer liner 40 includes have a rectangular shape (denoted "RS"). A second opening 57*b* is located between the first and third openings 57*a*, 57*c*. The first opening 57*a* includes a first geometric center 90*a*. The second opening 57*b* includes a second geometric center 90*b* and corresponds with the second mini combustor 34*b* (FIG. 5). The third opening 57*c* includes a third geometric center 90*c*. The first and third openings 57*a*, 57*c* are oriented such that the first and third geometric centers 90*a*, 90*c* are aligned in the circumferential direction CD and located at a first axial location A1. The second opening 57*b* is located at a second axial location A2, upstream from the first and third openings 57*a*, 57*c*. The first geometric center 90*a* and the second geometric center 90*b* are axially spaced from each other an axial distance (denoted "Ad"). The axial distance Ad is defined as an axial measurement between the first geometric center 90*a* and the second geometric center 90*b*.

The set of secondary combustors 50 (FIG. 2) can be staged to align with the first, second, and third openings 57*a*, 57*b*, 57*c*. The first and third mini combustors 34*a*, 34*c* (FIG. 2) are angled such that the secondary exhaust gasses G2 exhausting through the first and third openings 57*a*, 57*c* flow downstream away from the corresponding first and third primary fuel injectors 30*a*, 30*c*. The second mini combustor 34*b* (FIG. 5) is angled such that the secondary exhaust gasses G2 exhausting through the second opening 57*b* flows upstream, toward the corresponding second primary fuel injector 30*b*.

Figure 4:
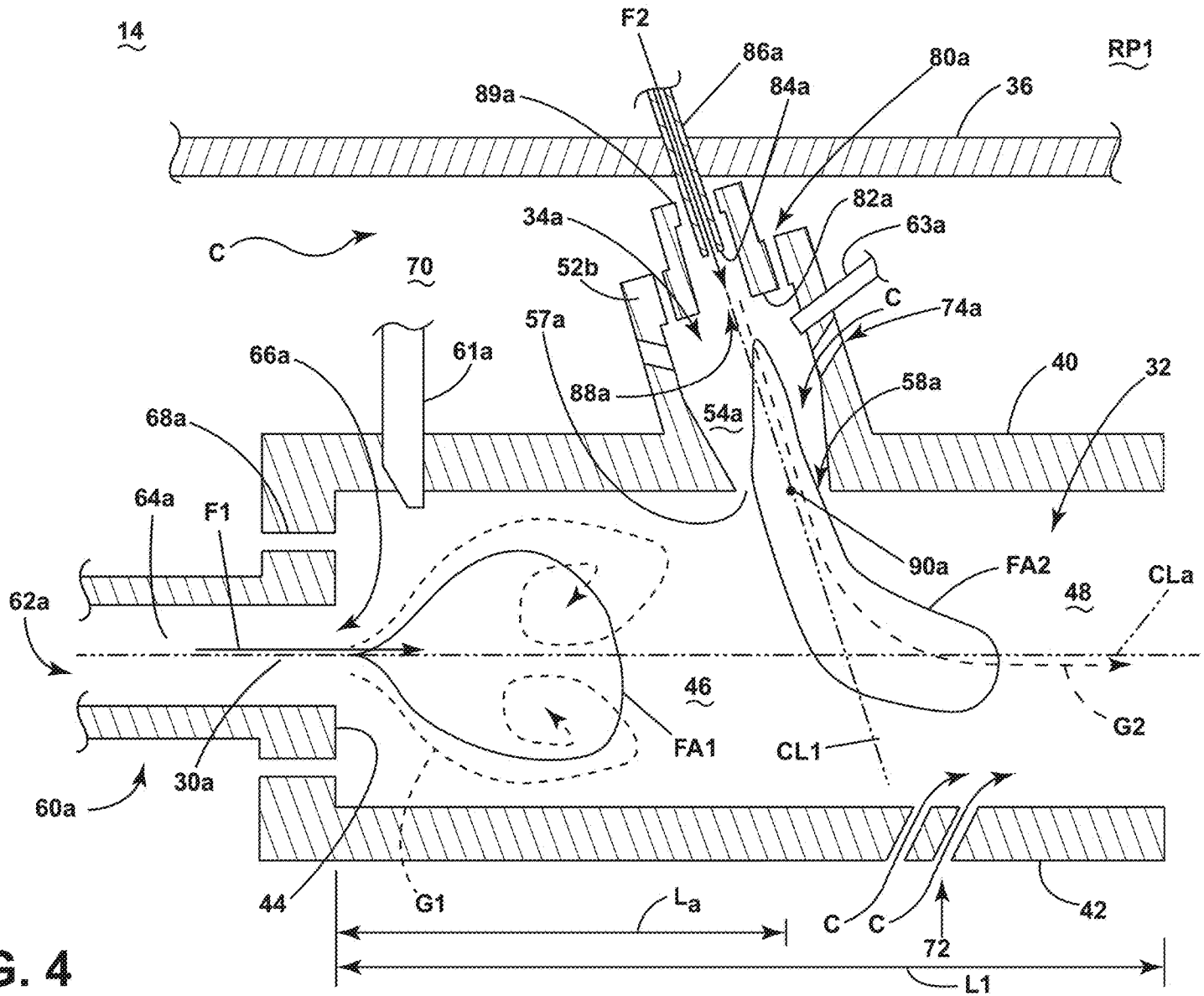
FIG. 4 is a cross-sectional view taken along line IV-IV of FIG. 3 illustrating a schematic of the combustion section as view in a first radial plane.

FIG. 4 depicts a cross-sectional view taken along line IV-IV of FIG. 3 illustrating a schematic of the combustion section 14 as viewed in a first radial plane (denoted "RP1"). The primary combustor 32 extends between the dome wall 44 and a primary combustor outlet 48. A first dome assembly 60*a* includes the dome wall 44 and houses the first primary fuel injector 30*a*. The first primary fuel injector 30*a* can be fluidly coupled to a first fuel inlet 62*a* via a first fuel passageway 64*a* that can be adapted to receive a primary flow of fuel (denoted "F1"). The first primary fuel injector 30*a* can terminate in a fuel outlet also referred to herein as a first primary dome inlet 66*a*. In some implementations the first primary fuel injector 30*a* can include a first swirler 68*a* circumferentially arranged about the first primary dome inlet 66*a*. The first opening 57*a* is located downstream from the first primary dome inlet 66*a*.

A first primary igniter 61*a* is fluidly coupled to the primary combustion chamber 46. A first secondary igniter 63*a* is fluidly coupled to the first mini combustor 34*a*, more specifically, a first secondary combustion chamber 54*a*.

A compressed air passageway 70 can surround the primary combustor 32 and be at least partially defined by the casing 36. Compressed air (denoted "C") can be provided to the combustion section 14 from the compressor section 12 (FIG. 1) via the compressed air passageway 70. The primary set of dilution openings 72 connects the compressed air passageway 70 and the primary combustion chamber 46.

A first secondary set of dilution openings 74*a* can be provided in a first secondary combustor liner 52*a* for connecting the compressed air passageway 70 and the first secondary combustion chamber 54*a*. By way of non-limiting example, when the primary combustor 32 is a rich burn system, the first secondary set of dilution openings 74*a* are at an aft location of the first mini combustor 34*a* for trimming a combustor exit temperature profile and pattern factor associated with the first mini combustor 34*a* and the primary combustor 32.

The compressed air C can be split between the primary combustor 32 and the set of secondary combustors 50 such that the primary combustor 32 receives 60% to 90% of the compressed air C from the compressor section 12 while the set of secondary combustors 50 receives between 10% and 40%.

The first mini combustor 34*a* includes a first mini dome assembly 80*a* including a first mini dome wall 82*a* and housing a first mini fuel injector 84*a*. The first mini fuel injector 84*a* can be fluidly coupled to a first secondary fuel passageway 86*a* that can be adapted to receive a secondary flow of fuel (denoted "F2"). The first mini fuel injector 84*a* terminates in a secondary fuel outlet also referred to herein as a first mini dome inlet 88*a* open to the first secondary combustion chamber 54*a*. In some implementations the first mini fuel injector 84*a* can include a first low swirl number swirler 89*a*, i.e., with a number less than 1 and having a low tangential velocity, circumferentially arranged about the first mini dome inlet 88*a*. It is further contemplated that the set of secondary combustors 50 do not include a swirler, but can have non swirling air passages.

The first primary dome inlet 66*a* defines a first primary centerline (denoted "CLa"). The first mini dome inlet 88*a* defines a first centerline CL1 extending toward a first secondary combustor outlet 58*a*. The first secondary combustor outlet 58*a* intersects the first centerline CL1 to define the first geometric center 90*a* of the first secondary combustor outlet 58*a*.

A total combustor length (denoted "L1") extends parallel to the first primary centerline CLa from the dome wall 44 to the primary combustor outlet 48. A first combustor length (denoted "La") extends parallel to the first primary centerline CLa from the dome wall 44 to the first geometric center 90*a*. The first combustor length La is from 5% to 80% of the total combustor length L1. In other words: $0.05L1<La<0.80L1$.

When the secondary exhaust gasses G2 are directed toward the primary combustor outlet 48, the exit temperature profile and the flame pattern factor improve for the primary combustor 32. The secondary exhaust gasses G2 trim the exist temperature profile and force a complete combustion of any unburnt product from the first mini combustor 34*a*. Mixing the products of combustion produced by the set of secondary combustors 50 with those of the primary combustor 32 helps to improve temperature distribution within the primary combustion chamber 46 due to higher turbulence created by the products impinging on each other.

FIG. 5 depicts a cross-sectional view taken along line V-V of FIG. 3 illustrating a schematic of the combustion section 14 as viewed in a second radial plane (denoted "RP2") circumferentially spaced from the first radial plane RP1 (FIG. 4). The primary combustor 32 extends between the dome wall 44 and the primary combustor outlet 48. A second dome assembly 60*b* includes the dome wall 44 and houses the second primary fuel injector 30*b*. The second primary fuel injector 30*b* can be fluidly coupled to a second fuel inlet 62*b* via a second fuel passageway 64*b* that can be adapted to receive the primary flow of fuel (denoted "F1"). The second primary fuel injector 30*b* can terminate in a fuel outlet also referred to herein as a second primary dome inlet 66*b*. In some implementations the second primary fuel injector 30*b* can include a second swirler 68*b* circumferentially arranged about the second primary dome inlet 66*b*. The second opening 57*b* is located downstream from the second primary dome inlet 66*b*. The second opening 57*b* is fluidly coupled to the second mini combustor 34*b* to define a second secondary combustor outlet 58*b*.

A second primary igniter 61*b* is fluidly coupled to the primary combustion chamber 46. A second secondary igniter 63*b* is fluidly coupled to the second mini combustor 34*b*, more specifically, a second secondary combustion chamber 54*b*.

A second secondary set of dilution openings 74*b* can be provided in a second secondary combustor liner 52*b* for connecting the compressed air passageway 70 and the second secondary combustion chamber 54*b*. By way of non-limiting example, when the second secondary set of dilution openings 74*b* are at a forward location of the second mini combustor 34*b* for providing additional mixing associated with the second mini combustor 34*b* and the primary combustor 32.

The second mini combustor 34*b* includes a second mini dome assembly 80*b* including a second mini dome wall 82*b* and housing a second mini fuel injector 84*b*. The second mini fuel injector 84*b* can be fluidly coupled to a second secondary fuel passageway 86*b* that can be adapted to receive the secondary flow of fuel (denoted "F2"). The second mini fuel injector 84*b* terminates in a secondary fuel outlet also referred to herein as a second mini dome inlet 88*b* open to the second secondary combustion chamber 54*b*. In some implementations the second mini fuel injector 84*b* can include a second low swirl number swirler 89*b*, i.e., with a number less than 1 and having a low tangential velocity, circumferentially arranged about the second mini dome inlet 88*b*. It is further contemplated that the set of secondary combustors 50 do not include a swirler, but can have non swirling air passages.

The second primary dome inlet 66*b* defines a second primary centerline (denoted "CLb"). The second mini dome inlet 88*b* defines a second centerline CL2 extending toward the second secondary combustor outlet 58*b*. The second secondary combustor outlet 58*b* intersects the second centerline CL2 to define the second geometric center 90*b* of the second secondary combustor outlet 58*b*.

A second combustor length (denoted "Lb") extends parallel to the second primary centerline CLb from the dome wall 44 to the second geometric center 90*b*. The second combustor length L2 is from 5% to 80% of the total combustor length L1. In other words: $0.05L<Lb<0.80L1$. The first geometric center 90*a* from FIG. 4 and the second geometric center 90*b* are axially spaced from each other an axial distance (denoted "Ad"). The axial distance Ad is from 0% to +/−60% of the total combustor length L1. In other words: $-0.60L1<Ad<0.60L1$.

The first geometric center 90*a* and the first centerline CL1 from FIG. 4 are illustrated to aid in defining an orientation angle β. The orientation angle β is the difference in orientation between the first mini combustor 34*a* (FIG. 4) and the second mini combustor 34*b*. The orientation angle β can range from 0° to 120°.

When the secondary exhaust gasses G2 are directed away from the primary combustor outlet 48, the primary exhaust gasses G1 and the secondary exhaust gasses G2 mix which reduces O2 levels in the primary combustion chamber 46 and reduces NOx emissions. An amount of secondary exhaust gasses G2 re-circulating in the primary combustion chamber 46 can range from 0.1% to 100% to cut down NOx emission.

During operation, referring to FIG. 4 and FIG. 5, compressed air C can be fed into the primary fuel injector 30 and mixed with the primary flow of fuel F1 to define a primary fuel/air mixture (denoted "FA1"). The first and second primary fuel injectors 30*a*, 30*b* along with the first and second primary igniters 61*a*, 61*b* define a primary burn system having a primary flame. The first and second primary fuel injectors 30*a*, 30*b* can dispense a primary fuel/air mixture FA1 that is premixed or partially premixed. Further the primary flow of fuel F1 can be a diffusion fuel free of an air mixture prior to entering the primary combustion chamber 46. The primary burn system can be a rich burn system or a lean burn system. A rich burn combustion system includes a fuel/air ratio above the stoichiometric fuel/air ratio whereas a lean burn combustion system includes a fuel/air ratio below the stoichiometric fuel/air ratio. A rich burn system for the primary combustor 32 will create a higher temperature within the primary combustion chamber 46 providing flame stability to the overall combustion system. When combined with a lean burn system for the set of secondary combustors 50, NOx is reduced from the first and second secondary combustion chambers 54*a*, 54*b*.

Similarly, the primary combustor 32 can be a lean burn system for lower NOx from the primary combustion chamber 46 with the set of secondary combustors 50 having a rich burn system for providing flame stability to the primary combustor 32 and the entire combustion system. Further both the primary combustor 32 and the set of secondary combustors 50 can be a rich burn system or a lean burn system. With both having lean burn systems, the amount of NOx emissions is greatly reduced. However, at least one or more of the first and second primary fuel injectors 30*a*, 30*b* or the first and second mini fuel injectors 84*a*, 84*b* will need to be fuel rich to provide flame stability. Likewise, both the primary combustor 32 and the set of secondary combustors 50 can have rich burn systems where lowering NOx in this system is achieved by staging fuel and starvation of O2 in the primary combustor 32 from product released from the set of secondary combustors 50 that produces lower NOx.

Compressed air C can be fed into the first and second mini fuel injectors 84*a*, 84*b* and mixed with the secondary flow of fuel F2 to define a secondary fuel/air mixture (denoted "FA2"). The first and second mini fuel injectors 84*a*, 84*b* along with the first and second secondary igniters 63*a*, 63*b* can define a mini burn system including a secondary flame that can be premixed, partially premixed, or diffusion. The mini burn system can be a rich burn system or a lean burn system. Fuel provided to the first and second primary fuel injectors 30*a*, 30*b* and the first and second mini fuel injectors 84*a*, 84*b* can include jet fuel natural gas or a more reacting fuel like H2 and blends of H2. In some implementations, the turbine engine 10 (FIG. 1) can be started on conventional fuel using the set of secondary combustors 50 where the secondary exhaust gasses G2 are propagated towards the primary combustion chamber 46 which can be fueled using conventional fuel or H2 fuel.

Fuel staging between the primary combustion chamber 46 and the set of secondary combustors 50 reduces the fuel/air ratio in these stages of the combustion section 14 (FIG. 1) which contributes to a further reduction in temperature and NOx emissions. In comparison a single staged combustor will have relatively higher fuel/air ratios and higher temperatures which leads to higher NOx emissions.

Figure 6B:
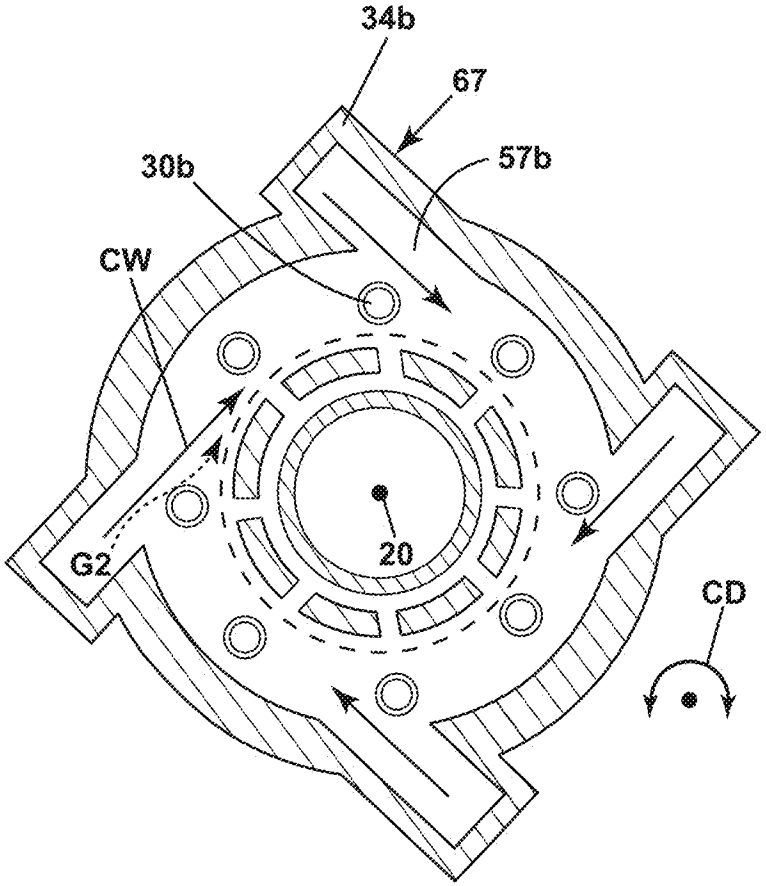
FIG. 6B is a cross-sectional view taken along line B-B of FIG. 3 illustrating an arrangement of a second stage of mini combustors.
Figure 6A:
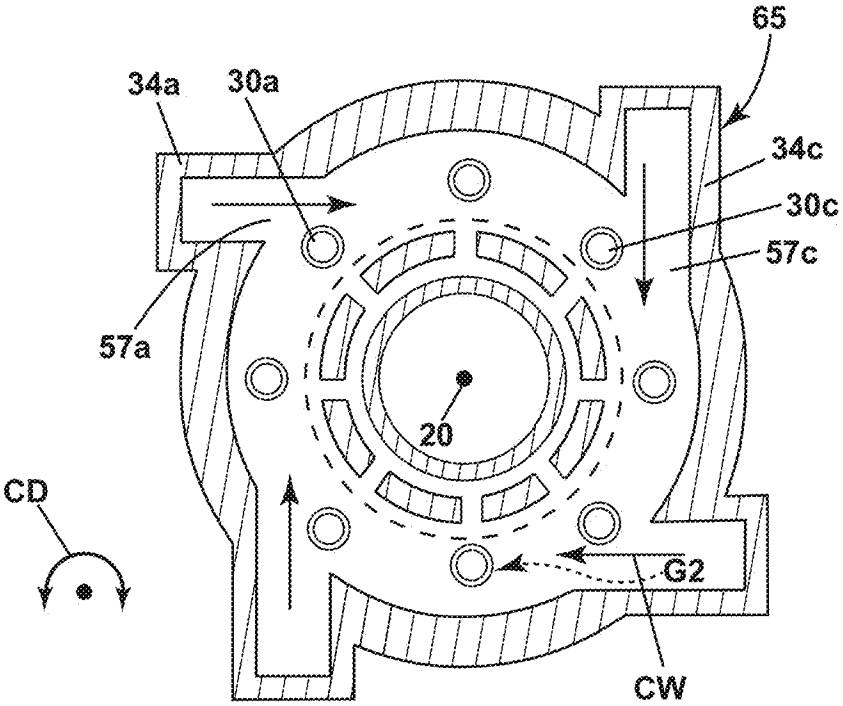
FIG. 6A is the same cross-sectional view as FIG. 2 illustrating an arrangement of a first stage of mini combustors.

FIG. 6A is the same cross-sectional view as FIG. 2 and taken along line A-A of FIG. 3, with the casing 36 and a majority of reference numerals removed for clarity. The first stage of mini combustors 65 are arranged such that the secondary exhaust gasses G2 are introduced in a first circumferential direction CD, by way of non-limiting example a clockwise direction (denoted "CW").

FIG. 6B is a cross-sectional view taken along line B-B of FIG. 3 with the casing 36 and a majority of reference numerals removed for clarity. A second stage of mini combustors 67 is located upstream from the first stage of mini combustors 65. The second stage of mini combustors 67 are arranged such that the secondary exhaust gasses G2 emitted from the second stage of mini combustors 67 are introduced in the same direction as the first circumferential direction CD, by way of non-limiting example, the clockwise direction CW. The second stage of mini combustors 67 includes at least the second mini combustor 34*b* along with the remaining illustrated mini combustors 34.

Figure 7B:
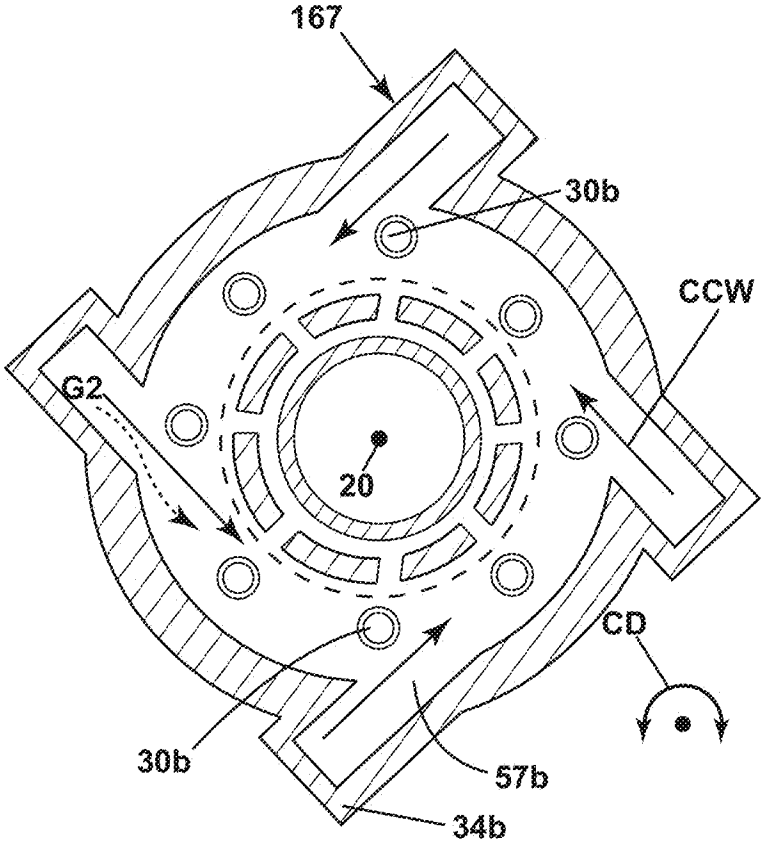
FIG. 7B is a variation of an arrangement of the second stage of mini combustors from FIG. 6B.
Figure 7A:
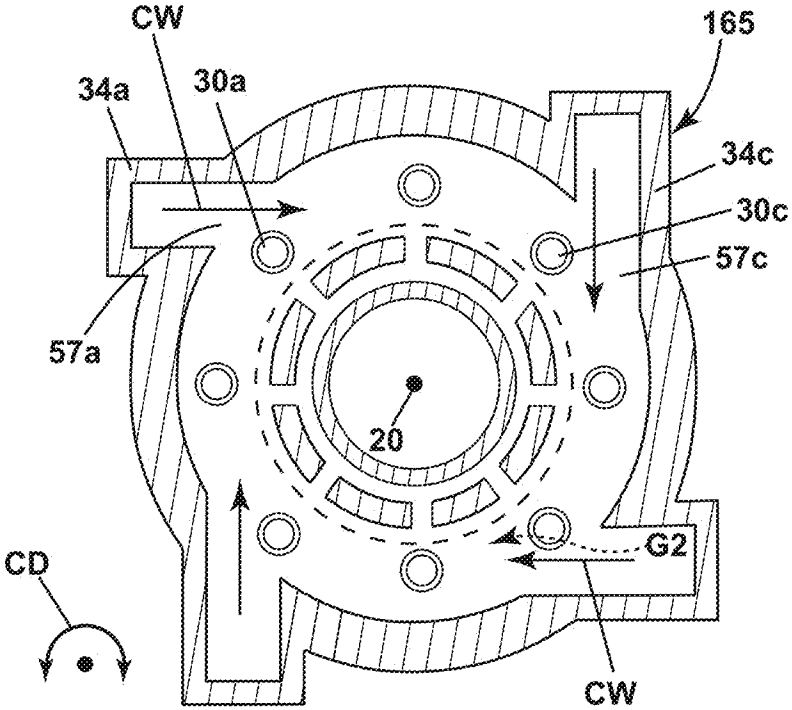
FIG. 7A is a variation of an arrangement of the first stage of mini combustors from FIG. 6A.

FIG. 7A is an alternate version of the cross-sectional view from FIG. 6A illustrating a first stage of mini combustors 165 arranged such that the secondary exhaust gasses G2 are introduced in the first direction, by way of non-limiting example a clockwise direction CW.

FIG. 7B is an alternate version of the cross-sectional view from FIG. 6B illustrating a second stage of mini combustors 167 located upstream from the first stage of mini combustors 165. The second stage of mini combustors 167 are arranged such that the secondary exhaust gasses G2 emitted from the second stage of mini combustors 167 are introduced in a second circumferential direction CD opposite the first direction. By way of non-limiting example, the second direction is a counterclockwise direction (denoted "CCW").

While the first direction disclosed herein is the clockwise direction CW, it should be understood that the first direction can be the counterclockwise direction CCW and the second direction can be the clockwise direction CW.

Figure 8:
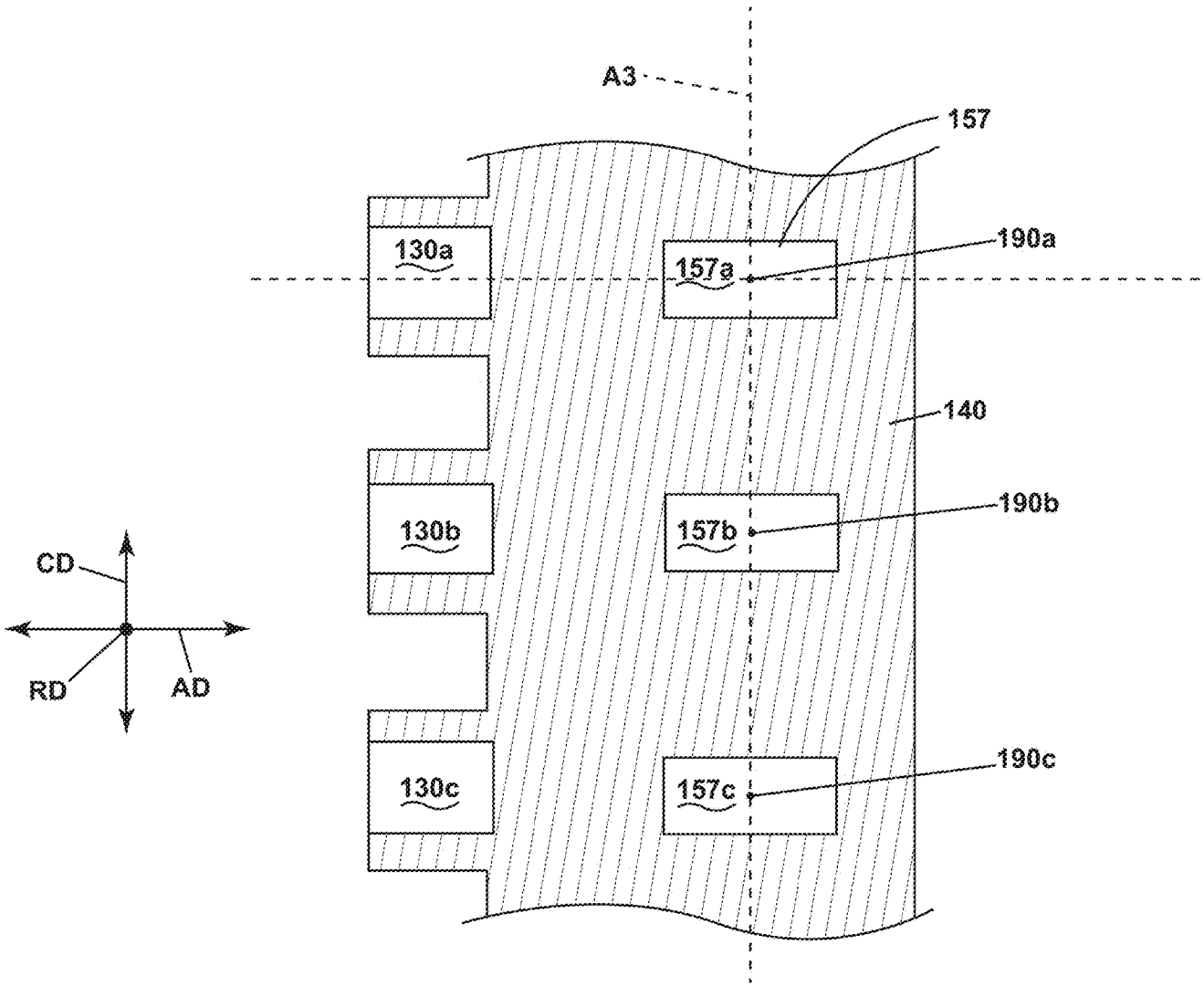
FIG. 8 is a schematic of a variation of the portion of the outer liner 40 from FIG. 3 according to another aspect of the disclosure herein.

FIG. 8 is a schematic of a variation of the portion of the outer liner 40 from FIG. 3 according to another aspect of the disclosure herein. An outer liner 140 is similar to the outer liner 40 of FIG. 3; therefore, like parts will be identified with like numerals increased by 100, with it being understood that the description of the like parts of the outer liner 40 applies to the outer liner 140, except where noted.

A set of openings 157 can include a first opening 157*a*, a second opening 157*b*, and a third opening 157*c*. The first opening 157*a* includes a first geometric center 190*a*. The second opening 157*b* includes a second geometric center 190*b*, and the third opening 157*c* includes a third geometric center 190*c*. The first, second, and third openings 157*a*, 157*b*, 157*c* are oriented such that the first, second, and third geometric centers 190*a*, 190*b*, 190*c* are aligned in the circumferential direction CD and are all located at a third axial location A3. The third axial location A3 can be the same as the first axial location A1 or the second axial location A2 (FIG. 3).

Figure 9:
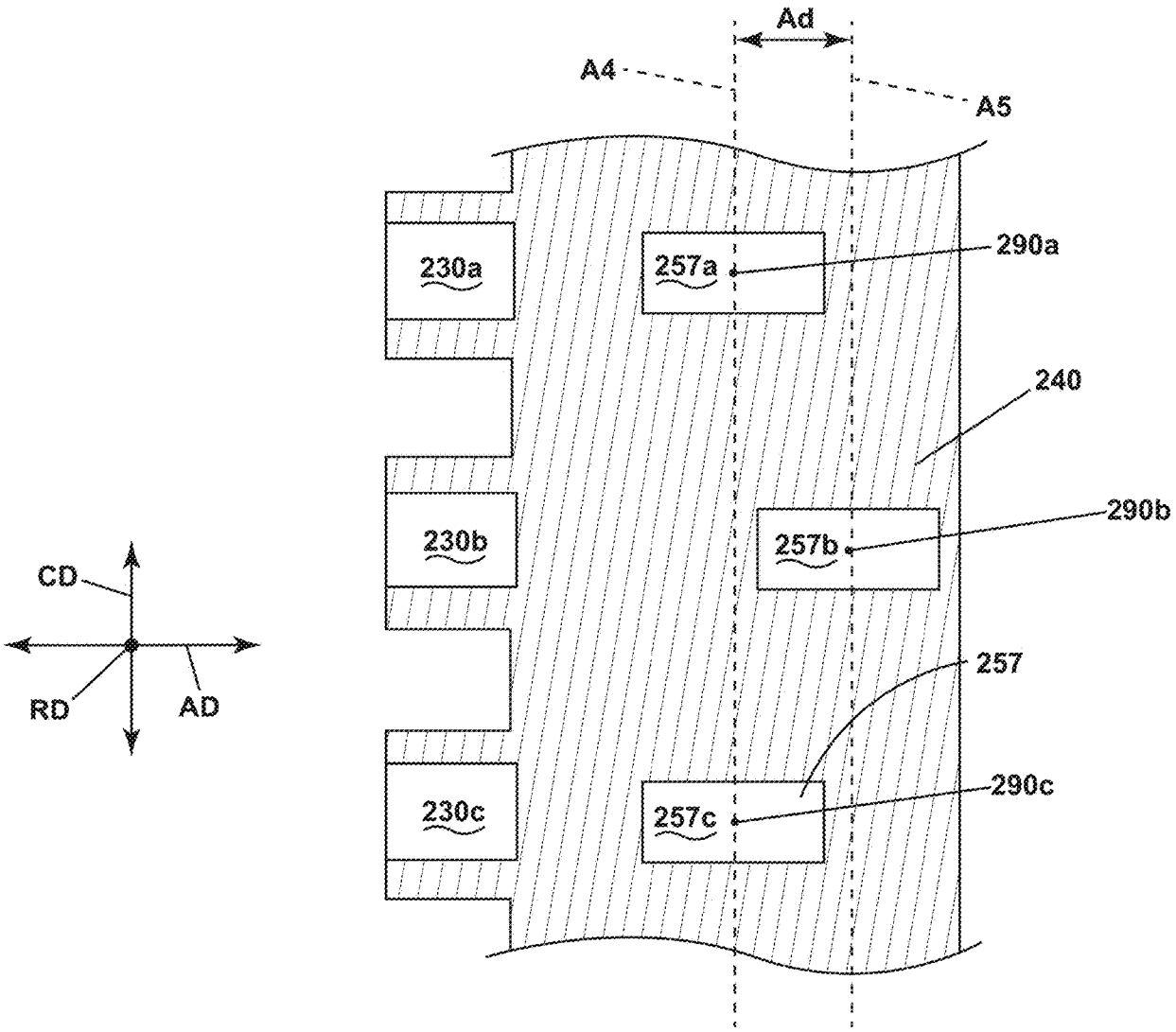
FIG. 9 is a schematic of another variation of the portion of the outer liner 40 from FIG. 3 according to another aspect of the disclosure herein.

FIG. 9 is a schematic of a variation of the portion of the outer liner 40 from FIG. 3 according to another aspect of the disclosure herein. An outer liner 240 is similar to the outer liner 40 of FIG. 3; therefore, like parts will be identified with like numerals increased by 200, with it being understood that the description of the like parts of the outer liner 40 applies to the outer liner 240, except where noted.

A set of openings 257 can include a first opening 257*a*, a second opening 257*b*, and a third opening 257*c*. The first opening 257*a* includes a first geometric center 290*a*. The second opening 257*b* includes a second geometric center 290*b*, and the third opening 257*c* includes a third geometric center 290*c*. The first and third openings 257*a*, 257*c* are oriented such that the first and third geometric centers 290*a*, 290*c* are aligned in the circumferential direction CD and located at a fourth axial location A4. The second opening 257*b* is located at a fifth axial location A5, downstream from the first and third openings 257*a*, 257*c*. The fourth axial location A4 can be the same as the first axial location A1, the second axial location A2 (FIG. 2), or the third axial location A3 (FIG. 8). An axial distance Ad is defined as an axial measurement between the fourth axial location A4 and the fifth axial location A5.

Figure 10:
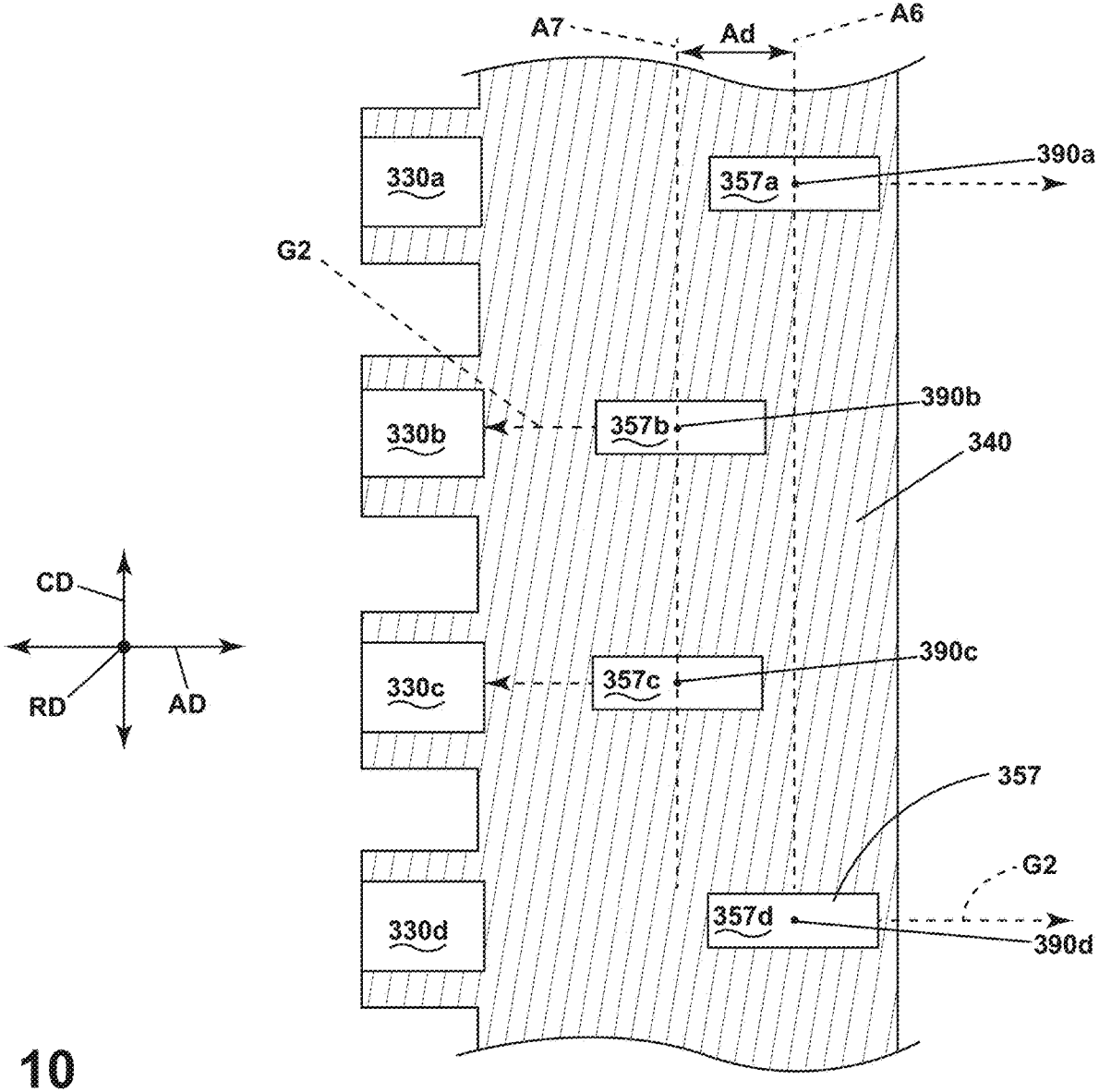
FIG. 10 is a schematic of yet another variation of the portion of the outer liner 40 from FIG. 3 according to another aspect of the disclosure herein.

FIG. 10 is a schematic of a variation of the portion of the outer liner 40 from FIG. 3 according to another aspect of the disclosure herein. An outer liner 340 is similar to the outer liner 40 of FIG. 3; therefore, like parts will be identified with like numerals increased by 300, with it being understood that the description of the like parts of the outer liner 40 applies to the outer liner 340, except where noted.

A set of openings 357 can include a first opening 357*a*, a second opening 357*b*, a third opening 357*c*, and a fourth opening 357*d*. The first opening 357*a* includes a first geometric center 390*a*, the second opening 357*b* includes a second geometric center 390*b*, the third opening 357*c* includes a third geometric center 390*c*, and the fourth opening includes a fourth geometric center 390*d*. The first and fourth openings 357*a*, 357*d* are oriented such that the first and fourth geometric centers 390*a*, 390*d* are aligned in the circumferential direction CD and located at a sixth axial location A6. The second and third openings 357*b*, 357*c* are located between the first and fourth openings 357*a*, 357*d* at a seventh axial location A7, upstream from the first and fourth openings 357*a*, 357*d*. The sixth axial location A6 can be the same as the first axial location A1, the second axial location A2 (FIG. 2), the third axial location A3 (FIG. 8), the fourth axial location A4, or the fifth axial location A5 (FIG. 9). An axial distance Ad is defined as an axial measurement between the sixth axial location A6 and the seventh axial location A7.

A set of secondary combustors (not visible) can be staged to align with the first, second, third, and fourth openings 357*a*, 357*b*, 357*c*, 357*d*. The corresponding mini combustors (not visible) for the first and fourth openings 357*a*, 357*d* can be angled such that the secondary exhaust gasses G2 exhausting through the first and fourth openings 357*a*, 357*d* flow downstream away from corresponding first and fourth primary fuel injectors 330*a*, 330*d*. The corresponding mini combustors (not visible) for the second and third openings 357*b*, 357*c* can be angled such that the secondary exhaust gasses G2 exhausting through the second and third openings 357*b*, 357*c* flow upstream toward corresponding second and third primary fuel injectors 330*b*, 330*c*.

Figure 11:
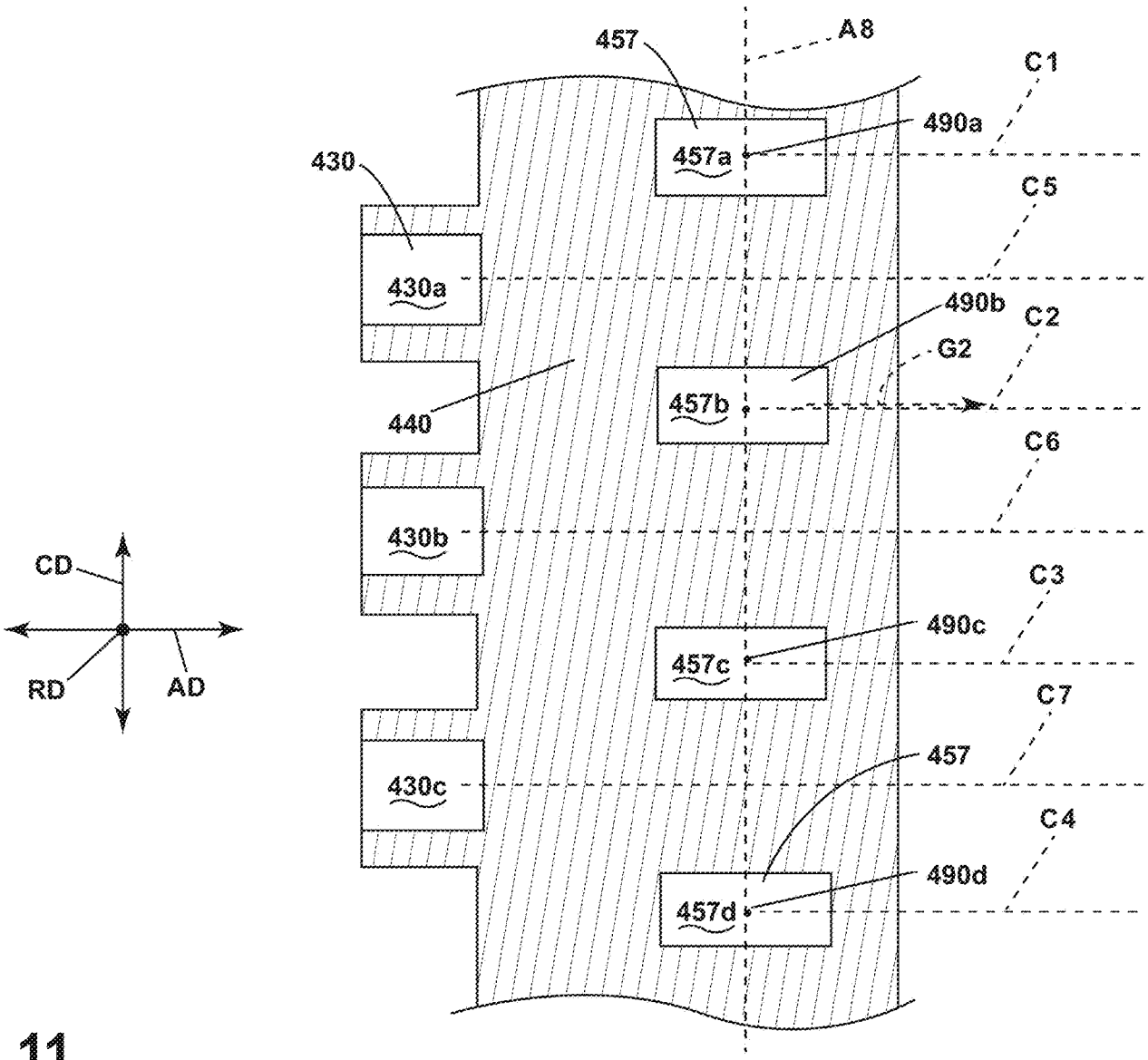
FIG. 11 is a schematic of an additional variation of the portion of the outer liner 40 from FIG. 3 according to another aspect of the disclosure herein.

FIG. 11 is a schematic of a variation of the portion of the outer liner 40 from FIG. 3 according to another aspect of the disclosure herein. An outer liner 440 is similar to the outer liner 40 of FIG. 3; therefore, like parts will be identified with like numerals increased by 400, with it being understood that the description of the like parts of the outer liner 40 applies to the outer liner 440, except where noted.

Thus far, all examples regarding the arrangement of openings in the outer liner have shown each opening axially aligned and located at the same circumferential location as a corresponding primary fuel injector. It is further contemplated that a set of openings 457 and a corresponding primary fuel injector 430 can be axially staggered and located at different circumferential locations.

A set of openings 457 can include a first opening 457*a*, a second opening 457*b*, a third opening 457*c*, and a fourth opening 457*d*. The first opening 457*a* includes a first geometric center 490*a* and is located at a first circumferential location C1. The second opening 457*b* includes a second geometric center 490*b* and is located at a second circumferential location C2. The third opening 457*c* includes a third geometric center 490*c* and is located at a third circumferential location C3. The fourth opening 457*d* includes a fourth geometric center 490*d* and is located at a fourth circumferential location C4. All first, second, third, and fourth openings 457*a*, 457*b*, 457*c*, 457*d* can be located at an eighth axial location A8.

The primary fuel injector 430 can include a first primary fuel injector 430*a*, a second primary fuel injector 430*b*, and a third primary fuel injector 430*c*. The first primary fuel injector 430*a* is located at a fifth circumferential location C5 between the first and second circumferential locations C1, C2. The second primary fuel injector 430*b* is located at a sixth circumferential location C6 between the second and third circumferential locations C2, C3. The third primary fuel injector 430*c* is located at a seventh circumferential location C7 between the third and fourth circumferential locations C3, C4.

The eighth axial location A8 can be the same as the first axial location A1 (FIG. 2), the second axial location A2 (FIG. 2), the third axial location A3 (FIG. 8), the fourth axial location A4 (FIG. 9), the fifth axial location A5 (FIG. 9), the sixth axial location A6 (FIG. 10), or the seventh axial location A7 (FIG. 10).

A set of secondary combustors (not visible) can be staged to align with the first, second, third, and fourth openings 457*a*, 457*b*, 457*c*, 457*d*. The corresponding mini combustors (not visible) for the first and fourth openings 457*a*, 457*d* can be angled such that the secondary exhaust gasses G2 exhausting through the first and fourth openings 457*a*, 457*d* flow downstream away from corresponding first and fourth primary fuel injectors 430*a*, 430*d*. The corresponding mini combustors (not visible) for the second and third openings 457*b*, 457*c* can be angled such that the secondary exhaust gasses G2 exhausting through the second and third openings 457*b*, 457*c* flow upstream toward corresponding second and third primary fuel injectors 430*b*, 430*c*.

Figure 12:
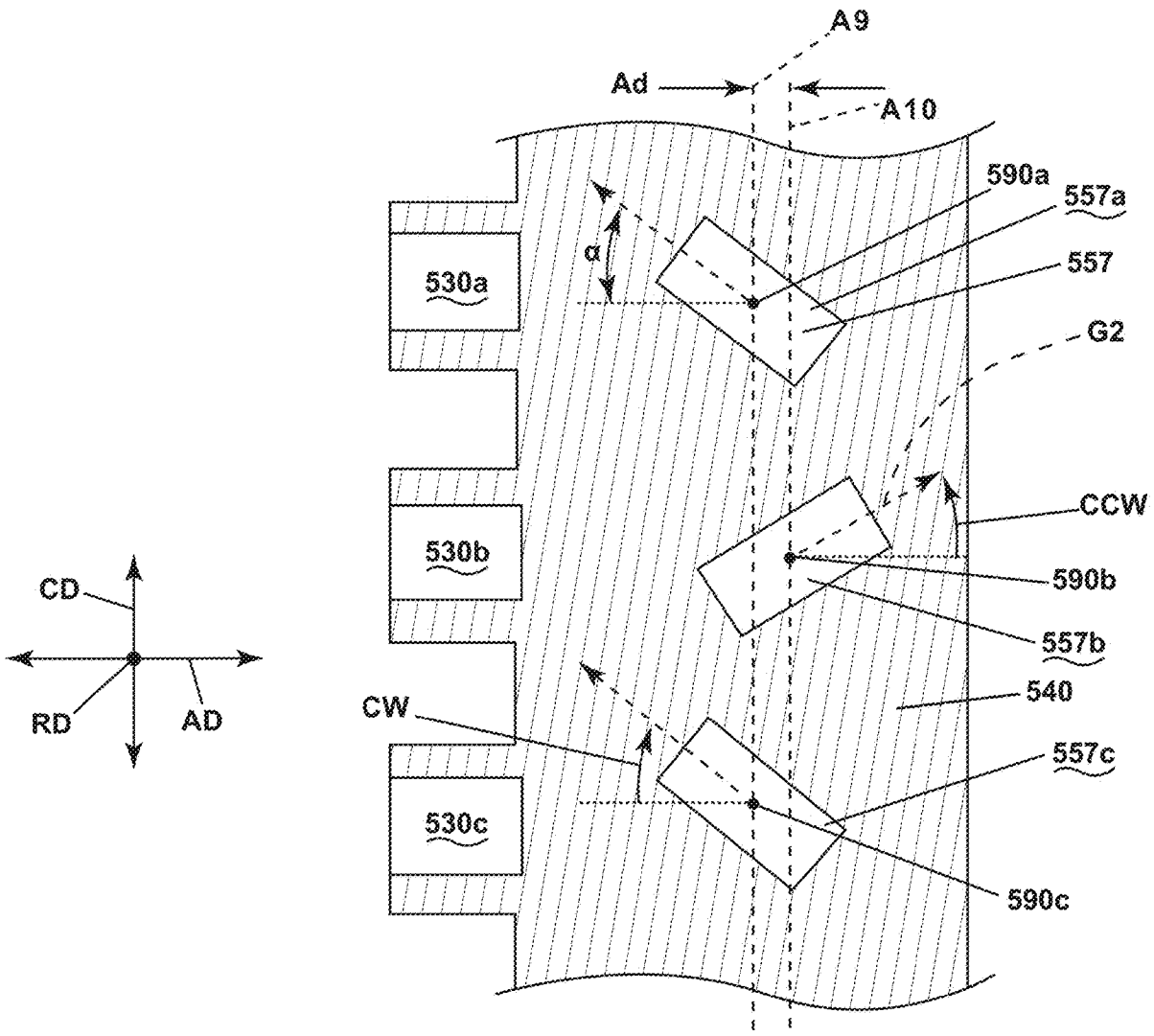
FIG. 12 is a schematic of yet another variation of the portion of the outer liner 40 from FIG. 3 according to another aspect of the disclosure herein.

FIG. 12 is a schematic of a variation of the portion of the outer liner 40 from FIG. 3 according to another aspect of the disclosure herein. An outer liner 540 is similar to the outer liner 40 of FIG. 3; therefore, like parts will be identified with like numerals increased by 500, with it being understood that the description of the like parts of the outer liner 40 applies to the outer liner 540, except where noted.

A set of openings 557 can include a first opening 557*a*, a second opening 557*b*, a and a third opening 557*c*. The first opening 557*a* includes a first geometric center 590*a*, the second opening 557*b* includes a second geometric center 590*b*, and the third opening 557*c* includes a third geometric center 590*c*. The first and third openings 557*a*, 557*c* are oriented such that the first and third geometric centers 590*a*, 590*c* are aligned in the circumferential direction CD and located at a ninth axial location A9. The second opening 557*b* is located between the first and third openings 557*a*, 557*c* at a tenth axial location A10, downstream from the first and third openings 557*a*, 557*c*. The ninth axial location A9 can be the same as the first axial location A1 (FIG. 2), the second axial location A2 (FIG. 2), the third axial location A3 (FIG. 8), the fourth axial location A4 (FIG. 9), the fifth axial location A5 (FIG. 9), the sixth axial location A6 (FIG. 10), the seventh axial location A7 (FIG. 10), or the eighth axial location A8 (FIG. 11). An axial distance Ad is defined as an axial measurement between the ninth axial location A9 and the tenth axial location A10.

Further, the first, second, and third openings 557*a*, 557*b*, 557*c* are turned from the axial direction AD toward the circumferential direction CD to define an opening angle (denoted "α"). In one aspect, the first and third openings 557*a*, 557*c* are turned clockwise (denoted "CW") and the second opening 557*b* is turned counterclockwise (denoted "CCW").

A set of secondary combustors (not visible) can be staged to align with the first, second, and third openings 557*a*, 557*b*, 557*c*. The corresponding mini combustors (not visible) for the first and third openings 557*a*, 557*c* can be angled such that the secondary exhaust gasses G2 exhausting through the first and third openings 557*a*, 557*c* flow upstream at the opening angle α, generally toward the corresponding first and third primary fuel injectors 530*a*, 530*c*. The corresponding mini combustor (not visible) for the second opening 557*b* can be angled such that the secondary exhaust gasses G2 exhausting through the second opening 557*b* flow downstream at the opening angle α, generally away from the corresponding second primary fuel injectors 530*b*.

Figure 13:
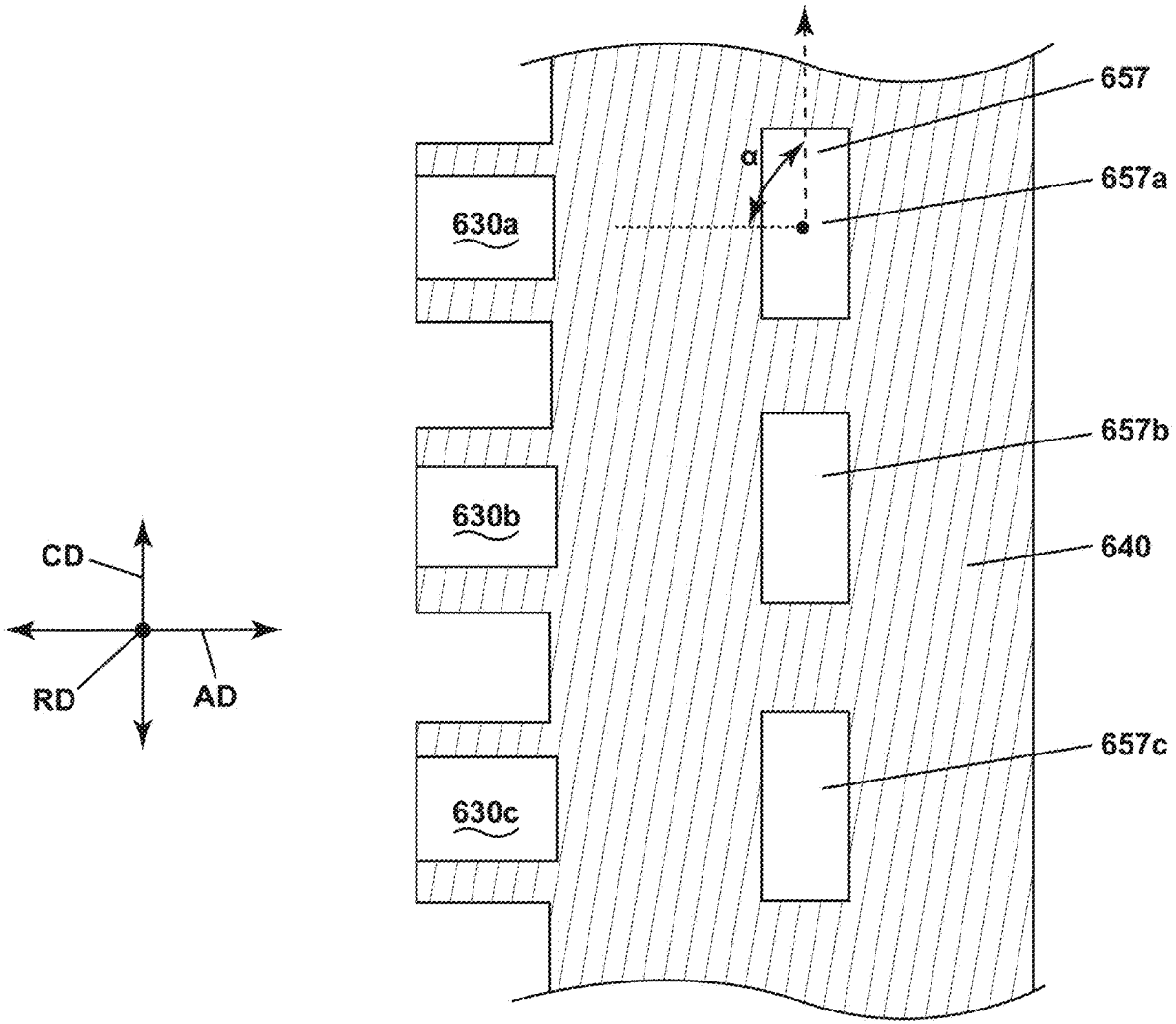
FIG. 13 is a schematic of another variation of the portion of the outer liner 40 from FIG. 3 according to another aspect of the disclosure herein.

FIG. 13 is a schematic of a variation of the portion of the outer liner 40 from FIG. 3 according to another aspect of the disclosure herein. An outer liner 640 is similar to the outer liner 40 of FIG. 3; therefore, like parts will be identified with like numerals increased by 600, with it being understood that the description of the like parts of the outer liner 40 applies to the outer liner 640, except where noted. The outer liner 640 includes a set of openings 657, including a first opening 657*a*, a second opening 657*b*, and a third opening 657*c* that are oriented such that the opening angle α is a 90-degree angle with respect to the multiple openings 157*a*, 157*b*, 157*c* illustrated in FIG. 8. In other words, the opening angle α can range from −90 degrees to 90 degrees.

Figure 14:
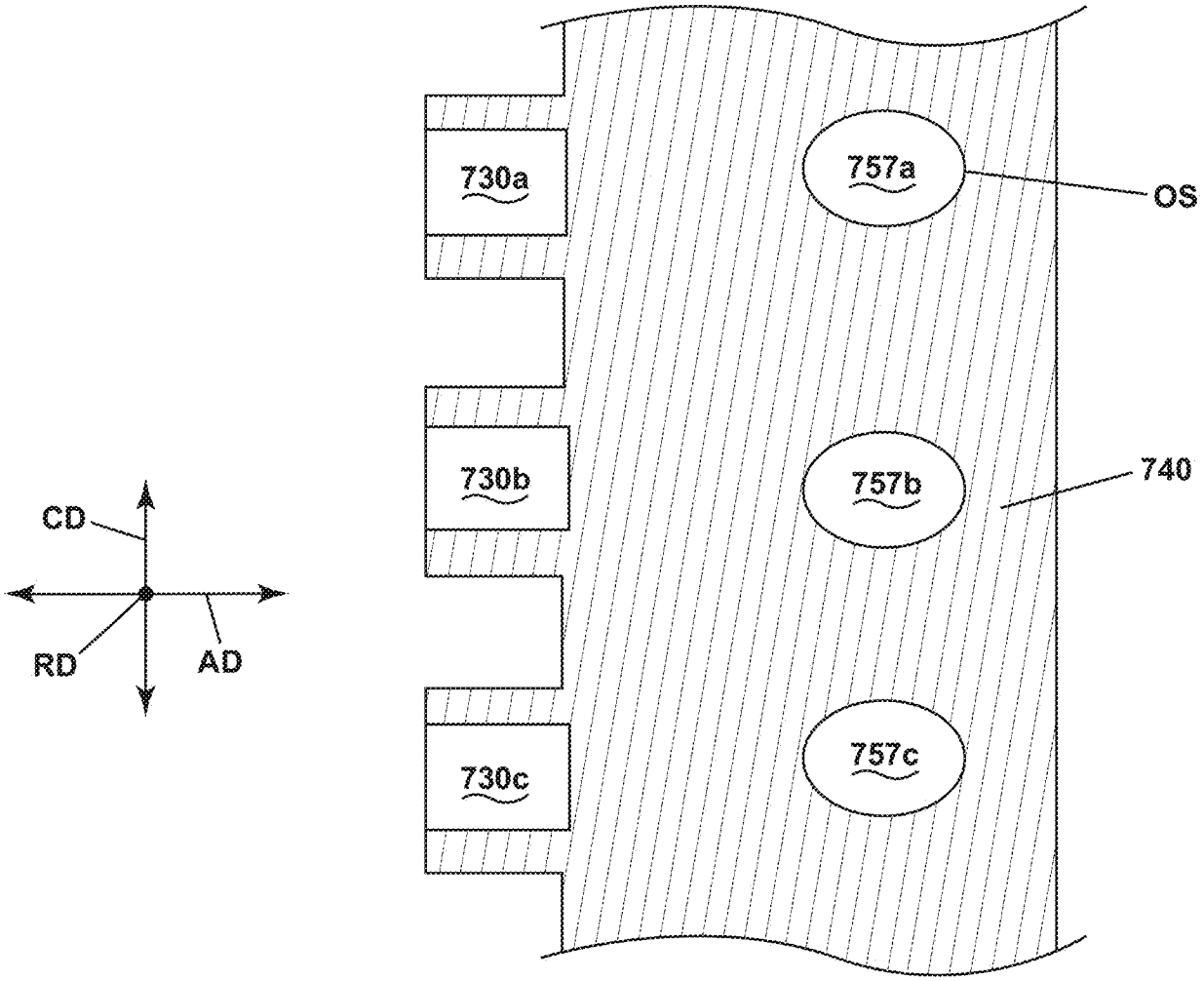
FIG. 14 is a schematic of another variation of the portion of the outer liner 40 from FIG. 3 according to another aspect of the disclosure herein.

FIG. 14 is a schematic of a variation of the portion of the outer liner 40 from FIG. 3 according to another aspect of the disclosure herein. An outer liner 740 is similar to the outer liner 40 of FIG. 3; therefore, like parts will be identified with like numerals increased by 700, with it being understood that the description of the like parts of the outer liner 40 applies to the outer liner 740, except where noted. The outer liner 740 includes multiple openings 757*a*, 757*b*, 757*c* having an oval shape (denoted "OS").

Any combination of the locations and orientations with respect to the openings 57, 57*a*, 57*b*, 57*c*, 157*a*, 157*b*, 157*c*, 257*a*, 257*b*, 257*c*, 357*a*, 357*b*, 357*c*, 357*d*, 457*a*, 457*b*, 457*c*, 457*d*, 557*a*, 557*b*, 557*c*, 657*a*, 657*b*, 657*c*, 757*a*, 757*b*, 757*c* described herein is contemplated. Further while three or four openings were illustrated, it should be understood that any number of openings is contemplated along with an appropriate corresponding number of mini combustors 34, 34*a*, 34*b*. The locations, orientations, number, and shapes can be tuned to achieve sufficient mixing between the two exhaust gasses G1, G2. It is also contemplated that any opening described herein can be a square or a circle. For a rectangle or oval/elliptical shape, the axis for the shape can extend along the main combustor axis or be lateral or inclined with respect to the main combustor axis.

A method for controlling nitrogen oxides present within the combustion sections 14 described herein includes generating the primary exhaust gasses G1 in the primary combustion chambers 46 and generating secondary exhaust gasses G2 in the set of secondary combustors 50 including the secondary combustion chambers 54*a*, 54*b*. The method further includes injecting the secondary exhaust gasses G2 into the primary combustion chambers 46. The method further includes introducing the secondary exhaust gasses G2 in an upstream direction toward the primary fuel injectors 30*a*, 30*b*, 30*c*, 130*a*, 130*b*, 130*c*, 230*a*, 230*b*, 230*c*, 330*a*, 330*b*, 330*c*, 330*d*, 430*a*, 430*b*, 430*c*, 530*a*, 530*b*, 530*c*, 630*a*, 630*b*, 630*c*, 730*a*, 730*b*, 730*c* and introducing the secondary exhaust gasses G2 in a downstream direction away from the primary fuel injectors 30*a*, 30*b*, 30*c*, 130*a*, 130*b*, 130*c*, 230*a*, 230*b*, 230*c*, 330*a*, 330*b*, 330*c*, 330*d*, 430*a*, 430*b*, 430*c*, 530*a*, 530*b*, 530*c*, 630*a*, 630*b*, 630*c*, 730*a*, 730*b*, 730*c*.

Benefits associated with the set of secondary combustors in combination with the primary combustor and methods described herein are to reduce NOx emissions even in a severe cycle with a higher operating air pressure, higher temperature, higher fuel/air ratio and with heated fuel. Typically, higher fuel/air ratio within a combustion system leads to a higher flame temperature which results in higher NOx. By having two combustion chambers within the combustion system, fuel can be split between these chambers thereby reducing the fuel/air ratio in each chamber and in turn achieving lower temperature and hence lower NOx emission. By directing product of combustion from a secondary combustion into a primary combustion chamber, O2 levels in the primary combustion chamber can be reduced, further reducing NOx emission. The combustion sections described herein can operate with 100% H2 fuel.

Additionally directing some stages forward and some stages aft towards exit can help in burning soot from main stage. Both stages will achieve lower main combustor zone temperature because of fuel staging and flame temperature reduction. The discrete mini stages inclined towards the main combustor vitiate main combustor flow reducing O2 level and hence reduces NOx emission. The aft facing mini stages can help to control exit temperature profile/pattern.

While described with respect to a turbine engine, it should be appreciated that the combustor as described herein can be for any engine with a having a combustor that emits NOx. It should be appreciated that application of aspects of the disclosure discussed herein are applicable to engines with propeller sections or fan and booster sections along with turbojets and turbo engines as well.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A combustion section for a turbine engine, the combustion section comprising a primary combustor liner including an inner liner and an outer liner annular about an engine centerline, wherein the outer liner defines a set of openings including at least a first opening and a second opening; a dome wall extending between the inner liner and the outer liner; a set of primary dome inlets located in the dome wall and circumferentially arranged about the engine centerline, the set of primary dome inlets located upstream from the set of openings and including at least a first primary dome inlet and a second primary dome inlet; a primary combustor having a primary combustion chamber defined at least in part by the inner liner, the outer liner, and the dome wall, and extending between the dome wall and a primary combustor outlet to define a total combustor length; a set of secondary combustors fluidly coupled to the primary combustion chamber at the set of openings, the set of secondary combustors comprising at least a first mini combustor oriented away from the first primary dome inlet and having a first mini dome inlet defining a first centerline extending away from the first primary dome inlet through the first opening; and a second mini combustor oriented toward the second primary dome inlet and having a second mini dome inlet defining a second centerline extending toward the second primary dome inlet through the second opening; wherein a difference in orientation between the first centerline and the second centerline defines an orientation angle ranging from 0° to 120°.

The combustion section of any preceding clause, wherein the first and second mini combustors are arranged to exhaust gasses in the same circumferential direction.

The combustion section of any preceding clause, wherein the first and second mini combustors are arranged to exhaust gasses in opposite circumferential directions.

The combustion section of any preceding clause, wherein the set of openings are multiple openings circumferentially arranged about the engine centerline.

The combustion section of any preceding clause, wherein the set of primary dome inlets and the set of openings are located at the same circumferential location.

The combustion section of any preceding clause, wherein the first opening is located at the same axial location as the second opening.

The combustion section of any preceding clause, wherein the first opening is located at a different axial location than the second opening.

The combustion section of any preceding clause, further comprising a third opening located at the same axial location as the second opening.

The combustion section of any preceding clause, further comprising a fourth opening located at the same axial location as the first opening, wherein the second and third openings are located between the first and fourth openings.

The combustion section of any preceding clause, wherein the set of primary dome inlets and the set of openings are located at different circumferential locations.

The combustion section of any preceding clause, wherein the first opening is located at the same axial location as the second opening.

The combustion section of any preceding clause, wherein the set of openings are turned from an axial direction toward a circumferential direction to define an opening angle.

The combustion section of any preceding clause, wherein the first opening is turned in a clockwise direction and the second opening is turned in a counterclockwise direction.

The combustion section of any preceding clause, wherein the first opening is located at a different axial location than the second opening.

The combustion section of any preceding clause, wherein the opening angle ranges from −90 to 90 degrees.

The combustion section of any preceding clause, wherein the set of openings are rectangular in shape.

The combustion section of any preceding clause, wherein the set of openings are oval in shape.

The combustion section of any preceding clause, wherein the first opening defines a first geometric center and the second opening defines a second geometric center spaced from the first geometric center an axial distance.

The combustion section of any preceding clause, wherein a first combustor length extends from the dome wall to the first geometric center and a second combustor length extends from the dome wall to the second geometric center, wherein the first combustor length and the second combustor length both range from 5% to 80% of the total combustor length.

The combustion section of any preceding clause, wherein the axial distance ranges from −60% to 60% of the total combustor length.

A method for controlling nitrogen oxides comprising generating a primary exhaust gas in a primary combustion chamber and generating secondary exhaust gasses in a set of secondary combustors each including a secondary combustion chamber; injecting first secondary exhaust gasses into a main combustion zone of the primary combustion chambers from a first mini combustor in a first direction along a first centerline; injecting second secondary exhaust gasses into a main combustion zone of the primary combustion chambers from a second mini combustor in a second direction along a second centerline oriented at a different orientation.

The method of any preceding clause further comprising introducing the first and second secondary exhaust gasses in the same circumferential direction.

The method of any preceding clause further comprising introducing the first and second secondary exhaust gasses in opposite circumferential directions.

What is claimed is:

1. A combustion section for a turbine engine, the combustion section comprising:

a primary combustor liner including an inner liner and an outer liner in annular arrangement;

a dome wall extending between the inner liner and the outer liner;

a set of primary dome inlets located in the dome wall;

a primary combustor having a primary combustion chamber defined at least in part by the inner liner, the outer liner, and the dome wall and defining a primary centerline; and a set of secondary combustors fluidly coupled to the primary combustion chamber at the outer liner, the set of secondary combustors comprising at least:

a first mini combustor provided in the outer liner; and a second mini combustor provided in the outer liner and spaced from the first mini combustor by an axial distance relative to the primary centerline;

wherein the first mini combustor and the second mini combustor generate combustion products that are injected into the primary combustion chamber.

2. The combustion section of claim 1, further comprising a set of openings provided in the outer liner, wherein the set of openings include at least a first opening and a second opening.

3. The combustion section of claim 2, wherein the first mini combustor is provided at the first opening and the second mini combustor is provided at the second opening.

4. The combustion section of claim 2, wherein the first opening is positioned forward of the second opening relative to the primary centerline.

5. The combustion section of claim 1, wherein the first mini combustor defines a first geometric center and the second mini combustor defines a second geometric center, and wherein the first geometric center is spaced from the second geometric center relative to the primary centerline.

6. The combustion section of claim 5, wherein the first geometric center is axially spaced from the second mini combustor.

7. The combustion section of claim 6, wherein the second geometric center is axially spaced from the first mini combustor.

8. The combustion section of claim 5, wherein the first geometric center overlaps with the second mini combustor relative to the primary centerline.

9. The combustion section of claim 8, wherein the second geometric center overlaps with the first mini combustor relative to the primary centerline.

10. The combustion section of claim 1, wherein the first mini combustor is angled toward the primary combustor, and wherein the second mini combustor is angled away from the primary combustor.

11. The combustion section of claim 1, wherein the first mini combustor is one of a set of first mini combustors in annular arrangement about the outer liner.

12. The combustion section of claim 11, wherein the second mini combustor is one of a set of second mini combustors in annular arrangement about the outer liner.

13. The combustion section of claim 12, wherein at least two first mini combustors of the set of first mini combustors are provided between adjacent second combustors of the set of second mini combustors, defined circumferentially about the primary centerline.

14. A combustion section for a turbine engine, the combustion section comprising:

a primary combustor liner including an inner liner and an outer liner in annular arrangement about an engine centerline, the engine centerline defining an axial direction along the engine centerline, defining a radial direction extending perpendicular from the engine centerline, and defining a circumferential direction extending circumferentially about the engine centerline;

a dome wall extending between the inner liner and the outer liner;

a set of primary dome inlets located in the dome wall and circumferentially arranged about the engine centerline;

a primary combustor having a primary combustion chamber defined at least in part by the inner liner, the outer liner, and the dome wall; and a secondary combustor fluidly coupled to the primary combustion chamber at the outer liner, wherein the secondary combustor is provided as a set of secondary combustors including at least a first mini combustor and a second mini combustor, wherein the first mini combustor and the second mini combustor are arranged to exhaust combustion products in the same circumferential direction;

wherein the secondary combustor is turned, along the outer liner at an opening angle, relative to the axial direction, such that the secondary combustor generates combustion products that are injected into the primary combustion chamber circumferentially about the outer liner respective of the opening angle.

15. The combustion section of claim 14, wherein the first mini combustor is oriented in a clockwise direction defined by the opening angle.

16. The combustion section of claim 15, wherein the second mini combustor is oriented in a counterclockwise direction defined by the opening angle.

17. The combustion section of claim 16, wherein the opening angle is -90 degrees or 90 degrees such that the secondary combustor is aligned with the circumferential direction.

* * * * *